US007905116B1

(12) United States Patent
Chen

(10) Patent No.: US 7,905,116 B1
(45) Date of Patent: Mar. 15, 2011

(54) FABRIC COLLECTION STRUCTURE FOR FABRIC CUTTING APPARATUS

(75) Inventor: Shih-Chi Chen, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 7 days.

(21) Appl. No.: 12/578,979

(22) Filed: Oct. 14, 2009

(51) Int. Cl.
*D04B 15/88* (2006.01)

(52) U.S. Cl. ..... 66/153

(58) Field of Classification Search ..... 66/147, 66/149 R, 150, 151, 152, 153
See application file for complete search history.

(56) References Cited

U.S. PATENT DOCUMENTS

| | | | | |
|---|---|---|---|---|
| 3,196,723 | A * | 7/1965 | Cohn et al. | 242/525 |
| 3,855,822 | A * | 12/1974 | Lee | 66/147 |
| 4,314,462 | A * | 2/1982 | Ducol et al. | 66/152 |
| 5,566,558 | A * | 10/1996 | Tsuchiya | 66/151 |
| 7,162,895 | B2 * | 1/2007 | Lonati | 66/151 |
| 7,204,103 | B1 * | 4/2007 | Chen | 66/153 |
| 7,600,400 | B2 * | 10/2009 | Lonati | 66/151 |

FOREIGN PATENT DOCUMENTS

| | | |
|---|---|---|
| TW | M307018 | 3/2007 |
| TW | M360247 | 7/2009 |

* cited by examiner

*Primary Examiner* — Danny Worrell
(74) *Attorney, Agent, or Firm* — Muncy, Geissler, Olds & Lowe, PLLC

(57) ABSTRACT

A fabric collection structure for a fabric cutting apparatus splits fabric and has a driving means. The fabric collection structure includes a fabric rolling rod and a fabric pressing means. The fabric pressing means has a fabric spread rod and a fabric pressing rod. During fabric collection, the driving means drives the fabric rolling rod, fabric spread rod and fabric pressing rod to rotate. The fabric split by the fabric cutting apparatus is flatly unfolded by the fabric spread rod and driven by the fabric pressing rod to be rolled on the fabric rolling rod, and is pressed by the fabric pressing rod. The fabric pressing rod is lifted by increasing thickness of the fabric rolled on the fabric rolling rod. The fabric rolling rod rolls the fabric at a fixed location. The fabric pressing means presses the fabric to control the density and a uniform fabric density is achieved.

7 Claims, 12 Drawing Sheets

FABRIC COLLECTION STRUCTURE FOR FABRIC CUTTING APPARATUS

FIELD OF THE INVENTION

The present invention relates to a fabric collection structure for fabric cutting apparatus and particularly to a high-stand fabric collection structure adopted for use on a knitting machine to collect fabric cut by a fabric cutting apparatus at high speeds.

BACKGROUND OF THE INVENTION

A conventional knitting machine such as a circular knitting machine generally relies on a fabric rolling machine to roll finished knitting fabric in a bundle. Depending on different fabric usage, some fabrics are cut before rolling. For instance, R.O.C. patent Nos. M360247 and M307018 disclose such a technique. They have a fabric cutting apparatus to cut fabric and a fabric collection means to collect the fabric. The fabric collection means mainly have two side chests that have two diagonal tracks located in the middle section and extended upwards to receive two ends of a fabric rolling rod, and two transverse first fabric directing shaft and second fabric directing shaft that are parallel with each other and located below the tracks. During the fabric rolling machine rolls the fabric, the first and second fabric directing shafts drive the fabric to the fabric rolling rod to be rolled. While the fabric increases gradually on the fabric rolling rod, the fabric rolling rod moves upwards along the tracks to collect the fabric.

However, after the fabric is split the width is doubled, the weight increases during fabric rolling, and the fabric on the fabric rolling rod presses the fabric directing shafts. With the weight increased gradually, the density of the collected fabric varies. The thickness of the fabric rolled at distal ends is thinner due to a greater downward pressure during rolling. As a result, one bundle of fabric usually has only the fabric rolled at the front end meeting required density standard, and the rest of fabric does not meet requirements. Thus waste of fabric occurs.

SUMMARY OF THE INVENTION

The primary object of the present invention is to solve the aforesaid disadvantages and provide a uniform pressure on the fabric rolling on the fabric rolling rod to form a uniform density of the rolled fabric.

To achieve the foregoing object, the present invention provides a fabric collection structure for fabric cutting apparatus. The fabric cutting apparatus splits fabric knitted by a knitting machine and has a driving means to drive the fabric collection structure to collect the fabric. The fabric collection structure includes a fabric rolling rod and a fabric pressing means. The fabric rolling rod is located axially on the fabric collection structure and driven by the driving means to rotate axially to roll the fabric. The fabric pressing means has a fabric spread rod and a fabric pressing rod that are also located axially on the fabric collection structure. The fabric spread rod is driven by the driving means to rotate axially to flatten the fabric split by the fabric cutting apparatus. The fabric pressing rod presses the fabric rolled on the fabric rolling rod and is driven by the driving means to rotate axially to drive the fabric rolling rod to roll the fabric. The fabric pressing rod is lifted by the fabric during fabric collection process by the increasing thickness of the fabric rolled on the fabric rolling rod.

Thus, the fabric rolling rod rolls the fabric at a fixed position, and the fabric pressing means provides a constant downward pressure on the fabric rolled on the fabric rolling rod. Compared with the conventional techniques, the present invention provides the fabric at a uniform density and improves fabric collection quality of the fabric cutting apparatus.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
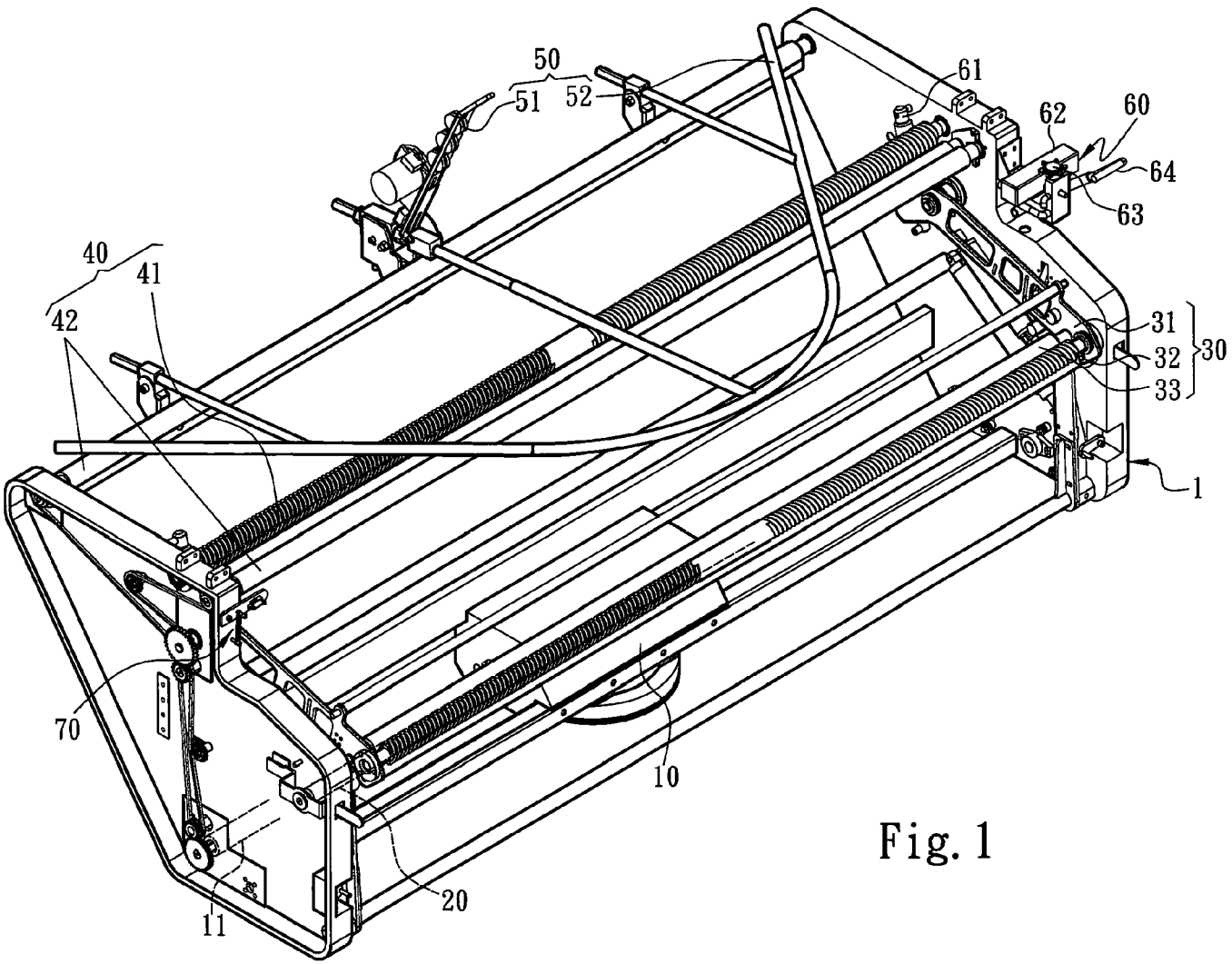
FIG. 1 is a perspective view of the invention.
Figure 2:
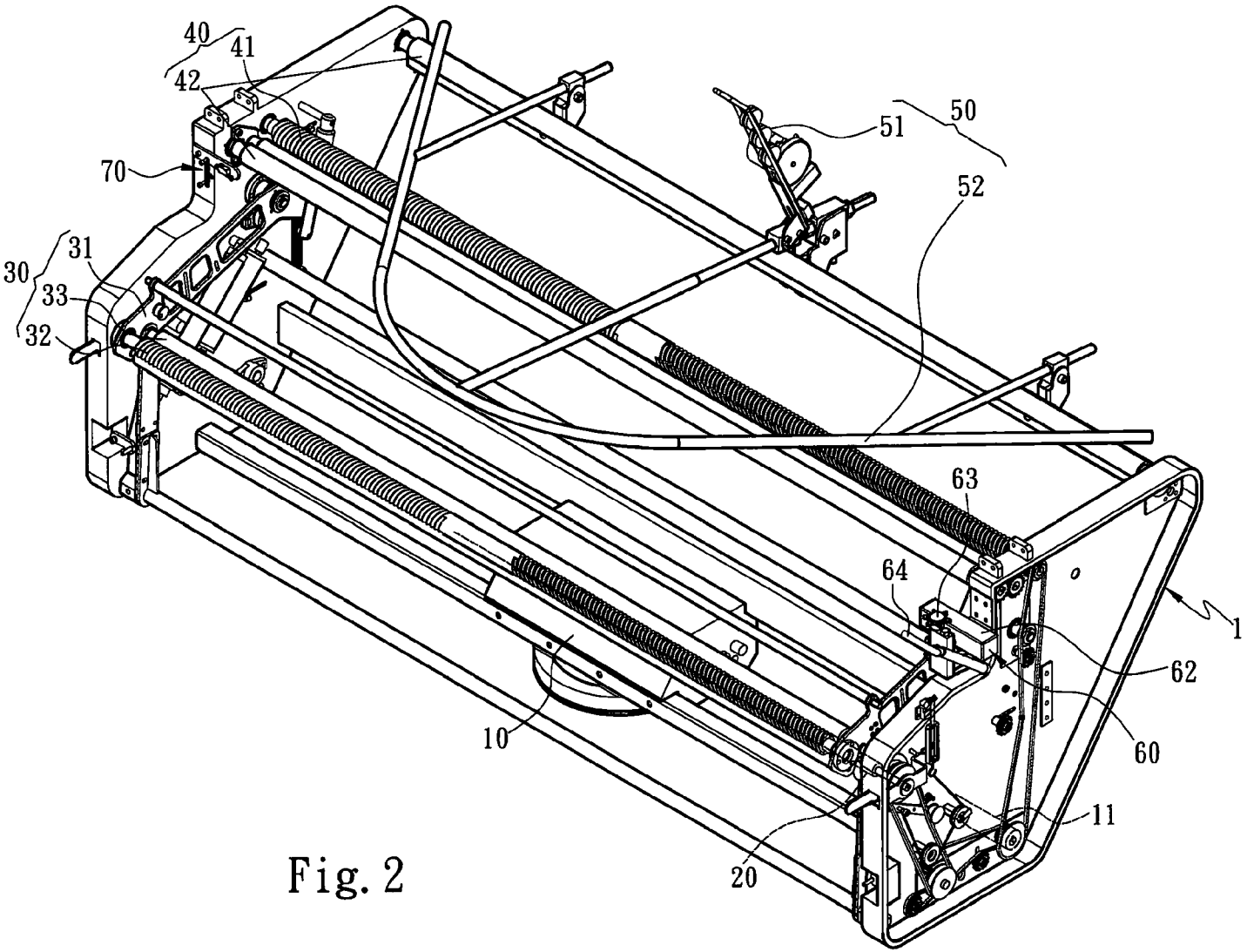
FIG. 2 is another perspective view of the invention.

Please refer to FIGS. 1 and 2, the present invention provides a fabric collection structure for fabric cutting apparatus that is to collect fabric at high stand and high speeds. The fabric cutting apparatus 50 has a cutter 51 to split fabric knitted by a knitting machine and a fabric prop rod 52 to prop the fabric. The fabric collection structure aims to collect the fabric, and has two side chests 1 and also includes, between them in this order from the lower side to the upper side, a driving means 10, a fabric rolling rod 20, a fabric pressing means 30 and a fabric conveying means 40. The fabric cutting apparatus 50 is located above the fabric conveying means 40 to split the fabric. Then the split fabric is sent to the fabric collection structure through the fabric conveying means 40.

The driving means 10 is located between the two side chests 1 close to the bottom, and has a shaft 11 extended from the interior with two ends running into the two side chests 1. The fabric rolling rod 20 is axially held between the two side chests 1 close to the center. The fabric pressing means 30 includes arms 31 respectively pivotally located on the two side chests 1 and a first fabric spread rod 32 and a fabric pressing rod 33 that are axially located between the two arms 31. The fabric conveying means 40 is located between the two side chests 1 at the top, and has a second fabric spread rod 41 and a plurality of rolling rods 42 that are located axially on the two side chests 1. There are also a plurality of transmission wheels and transmission belts winding the transmission wheels in the two side chests 1. When the driving means 10 is in operation, it drives the fabric rolling rod 20, fabric pressing means 30 and fabric conveying means 40 simultaneously.

Figure 3A:
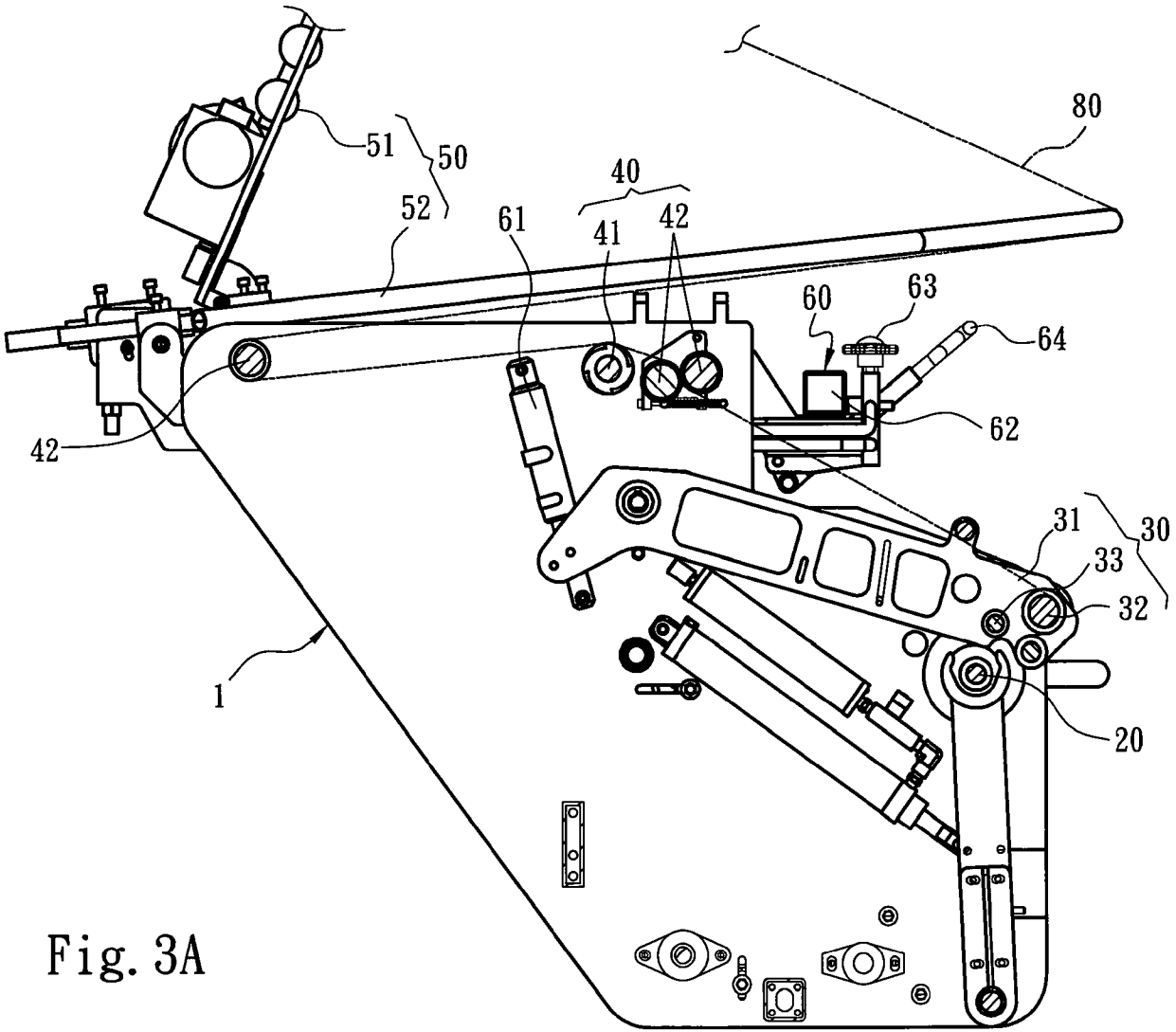
FIGS. 3A and 3B are schematic views of the invention in fabric collecting conditions.
Figure 3B:
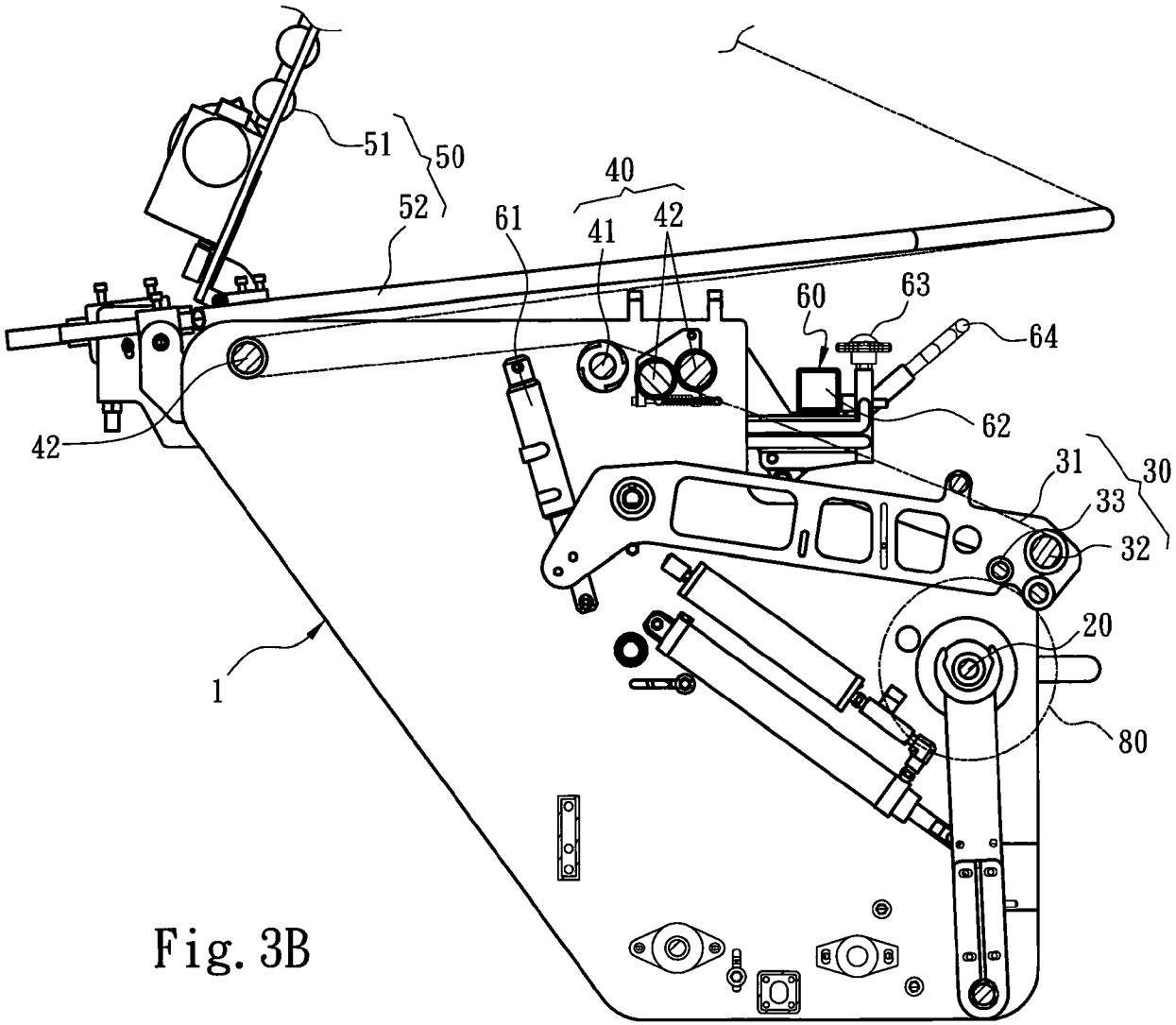

Referring to FIGS. 3A and 3B, when in operation, fabric 80 is first split by the fabric cutting apparatus 50; through the rolling rods 42 and second fabric spread rod 41 of the fabric conveying means 40, the fabric 80 is directed to the fabric pressing means 30 which flatly unfolds the fabric 80 through the first fabric spread rod 32 and prevent the split fabric 80 from rolling back due to tension at two edges; next, the fabric 80 is sent to the fabric rolling rod 20 through the fabric pressing rod 33 (referring to FIG. 3A); as the fabric rolling rod 20 rolls the fabric 80 at a fixed location, with progress of operation, the quantity of fabric 80 rolled on the fabric rolling rod 20 increases, and the fabric pressing rod 33 is in contact with the fabric 80 and lifted upwards (referring to FIG. 3B); due to the fabric 80 receives a constant pressure from the fabric pressing rod 33, the density of the rolled fabric 80 is uniform. Hence the problem of the conventional fabric cutting apparatus 50 that adopts a movable fabric rolling rod 20 to roll the fabric and results in non-uniform density of the fabric 80 due to increasing pressure on the fabric 80 caused by increasing thickness of the fabric 80 can be prevented.

Figure 4:
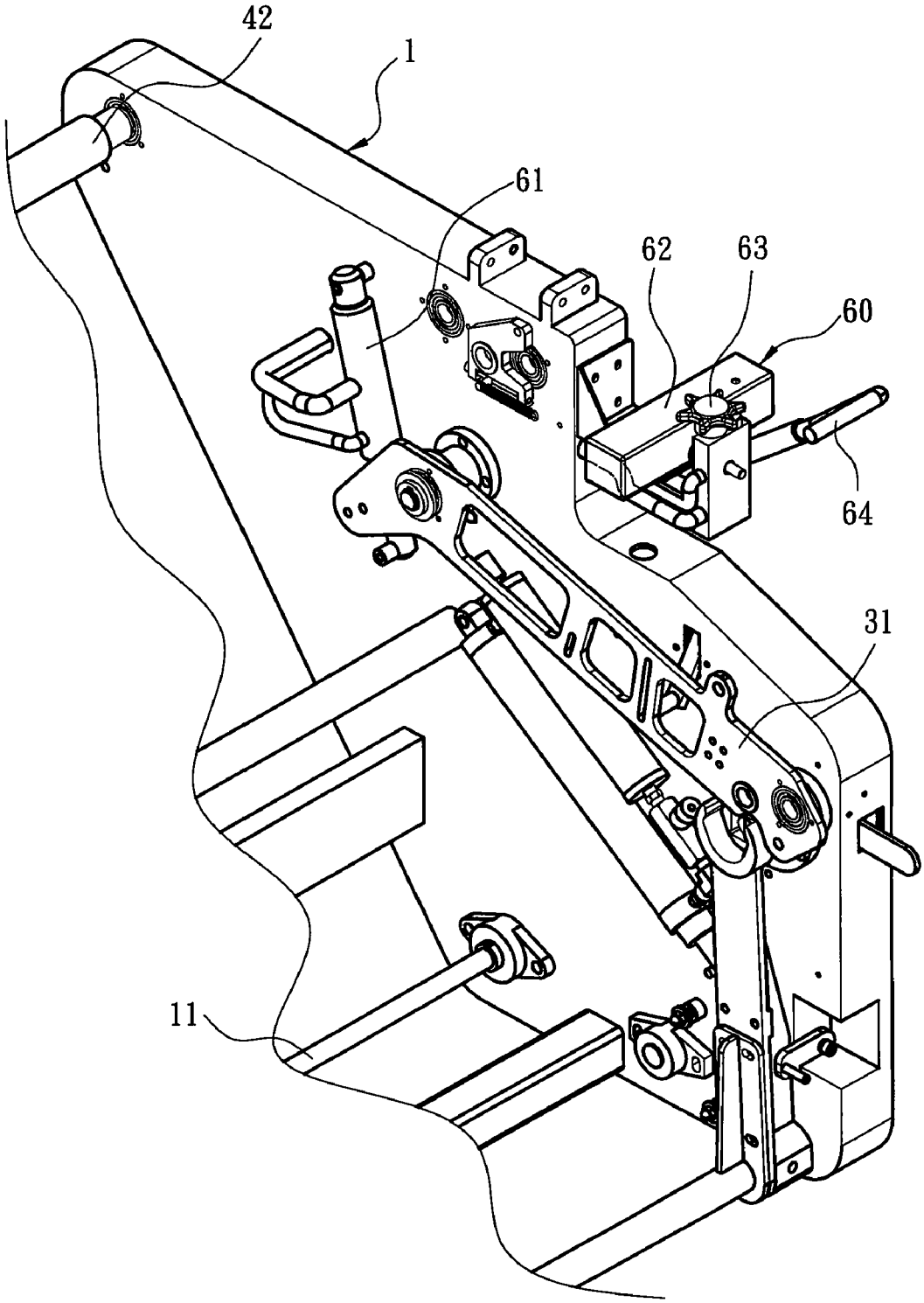
FIG. 4 is a perspective view of the control means of the invention.
Figure 5A:
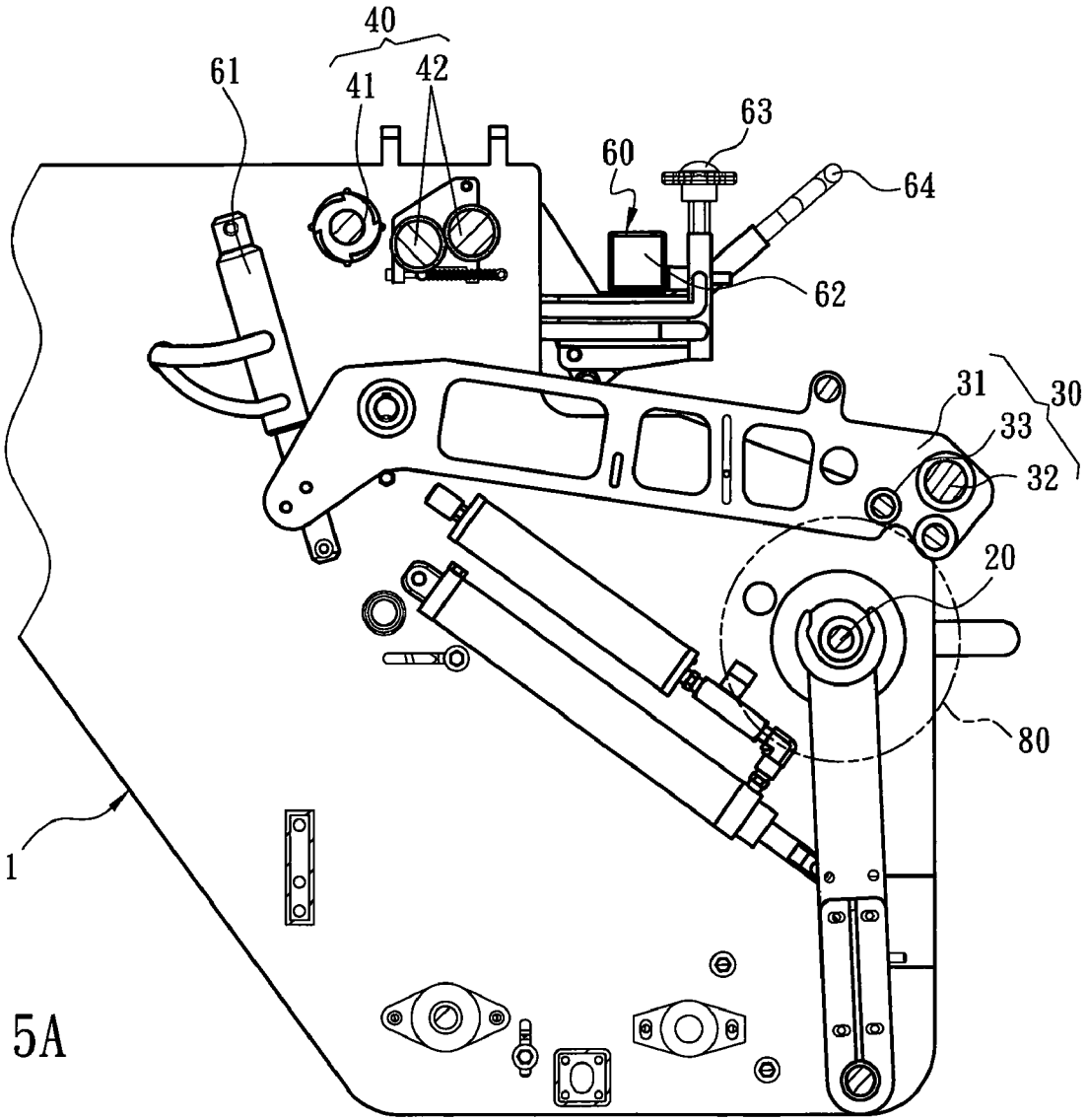
FIGS. 5A and 5B are schematic views of the control means in operating conditions.
Figure 5B:
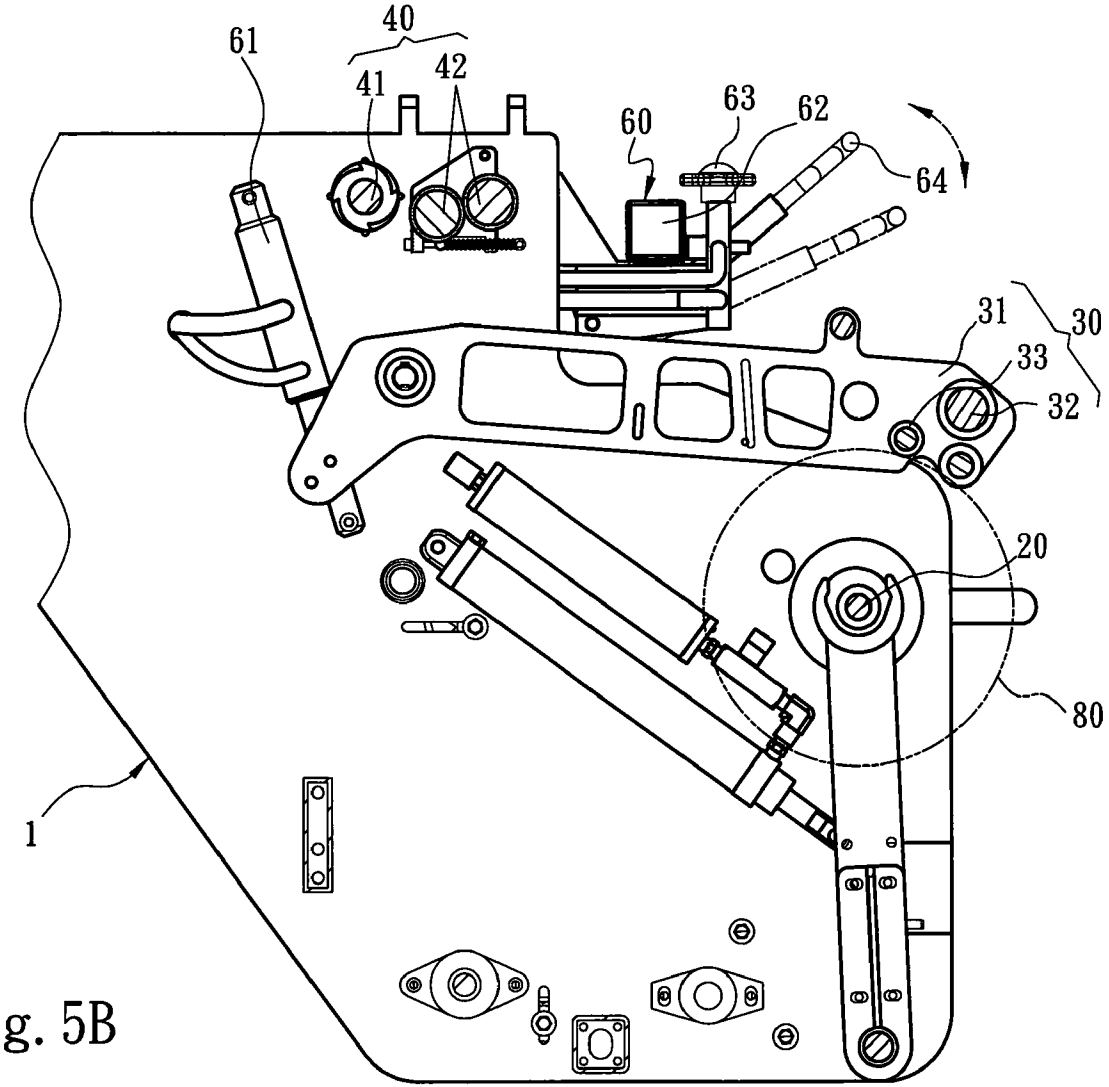

After the fabric 80 is split by the fabric cutting apparatus 50, the width of the fabric 80 doubles. Hence the length of the first fabric spread rod 32 and fabric pressing rod 33 also have to be doubled to mate the width of the split fabric 80. This results in a greater weight of the fabric pressing means 30 and difficulty of manual lifting, and unloading the fabric after the fabric collection operation is finished or inspecting the fabric during operation is difficult. To overcome this problem, the fabric collection structure of the invention further provides a control means 60 coupling with the fabric pressing means 30 to adjust the elevation thereof. Referring to FIG. 4, the control means 60 includes an oil pressure buffer 61 connecting to the arm 31 of the fabric pressing means 30 and an oil pressure control box 62 to control oil pressure of the oil pressure buffer 61. The oil pressure control box 62 has an oil pressure control switch 63 to boost or release the oil pressure of the oil pressure buffer 61 to do adjustment desired and a pressure boosting handle 64 to boost the oil pressure of the oil pressure buffer 61. Referring to FIGS. 5A and 5B, during fabric collection process, the oil pressure control switch 63 is opened to release the oil pressure of the oil pressure buffer 61 so that the fabric 80 can lift and move the fabric pressing rod 33 (referring to FIG. 5A). When the fabric collection process is finished and the fabric has to be unloaded or fabric inspection is needed during operation, wrench the oil pressure control switch 63 tightly to boost the pressure of the oil pressure buffer 61 and press the handle downwards to further increase the pressure of the oil pressure buffer 61, and turn the arm 31 upwards to move the fabric pressing rod 33 away from the fabric 80, the fabric can be unloaded or inspected (referring to FIG. 5B). Thus the fabric pressing means 30 can be lifted without relying a lot of manpower and manual operation is easier.

Figure 6:
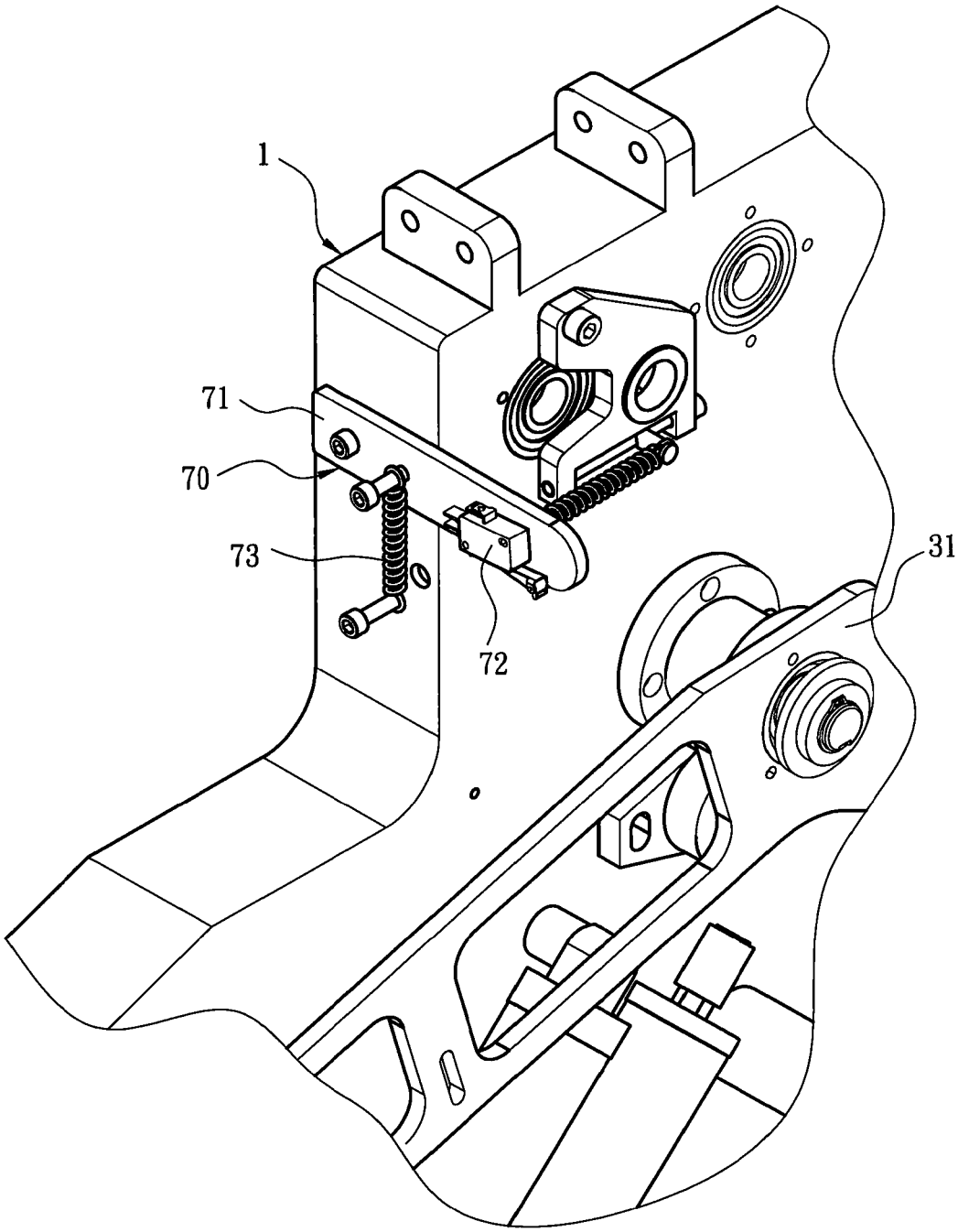
FIG. 6 is a perspective view of the safety means of the invention.
Figure 7A:
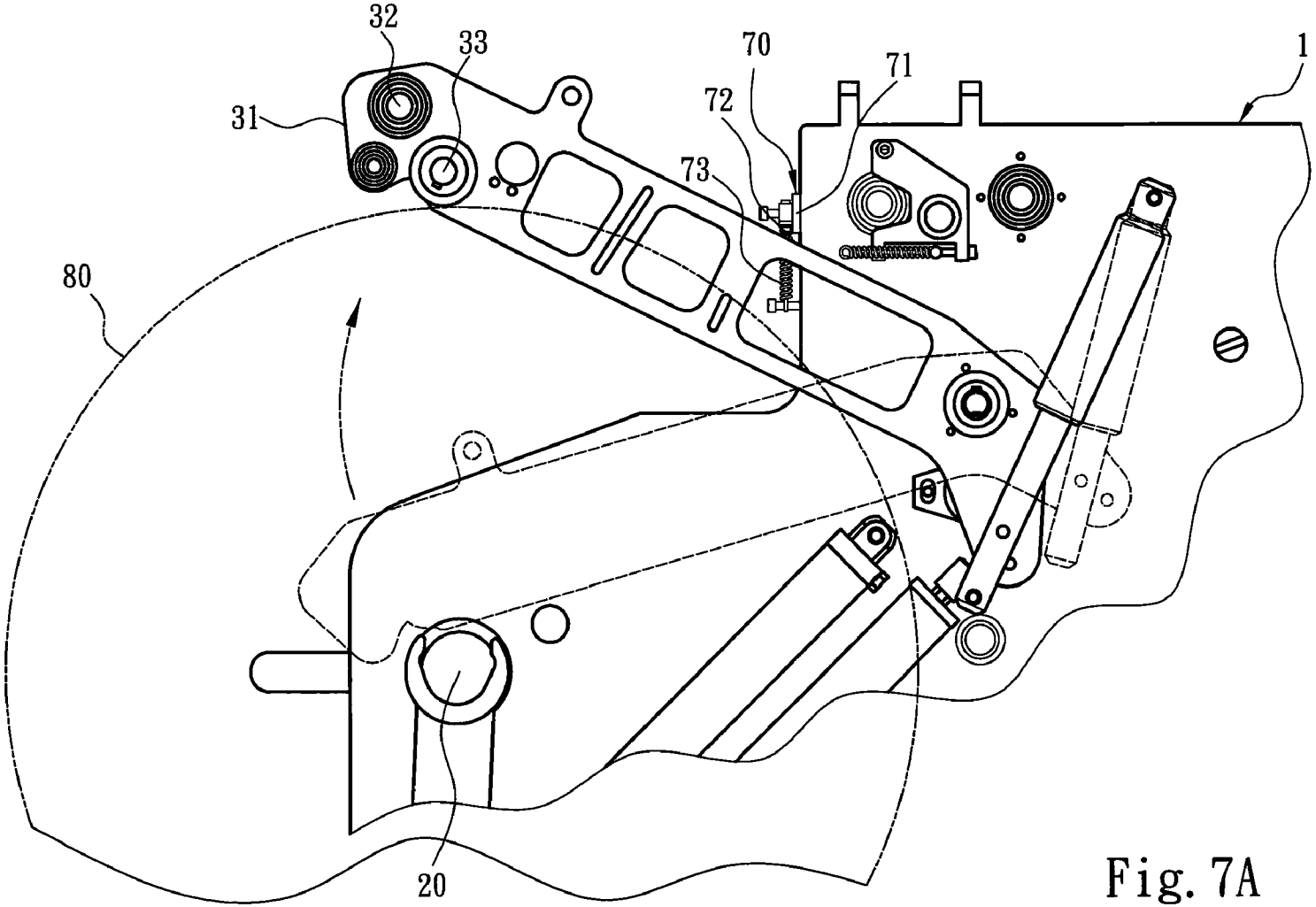
FIGS. 7A through 7D are schematic views of the safety means in operating conditions.
Figure 7B:
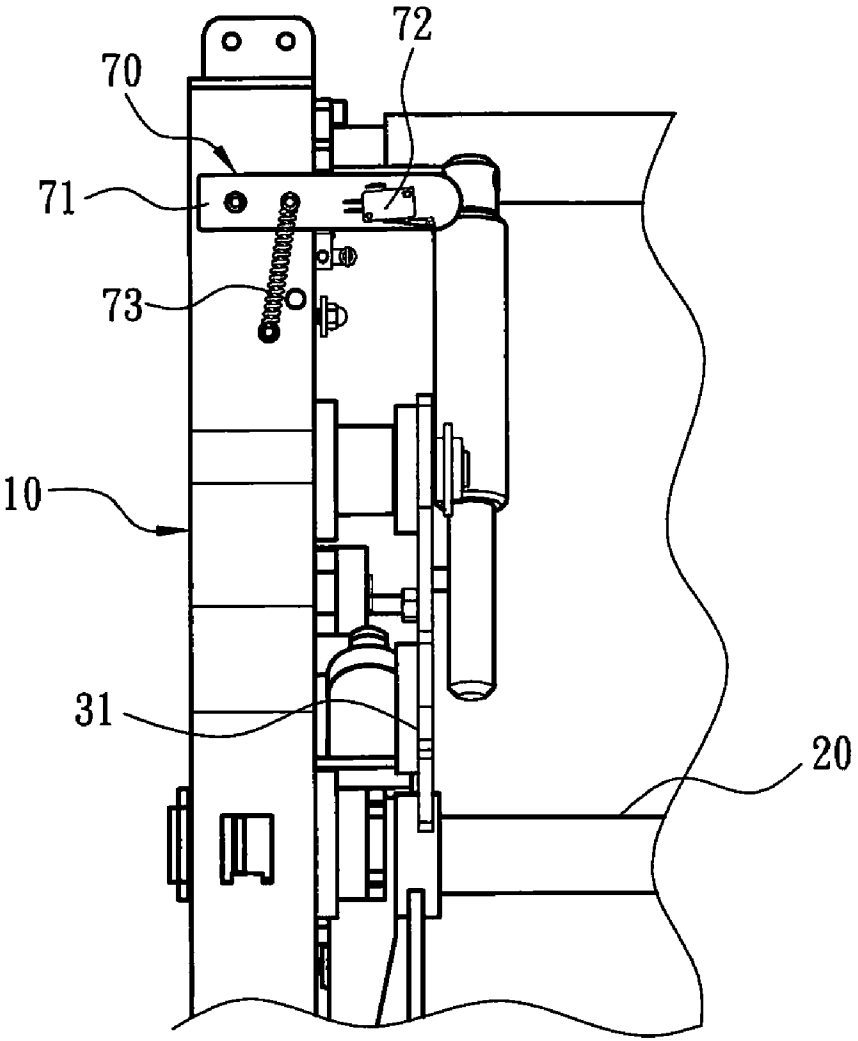
Figure 7C:
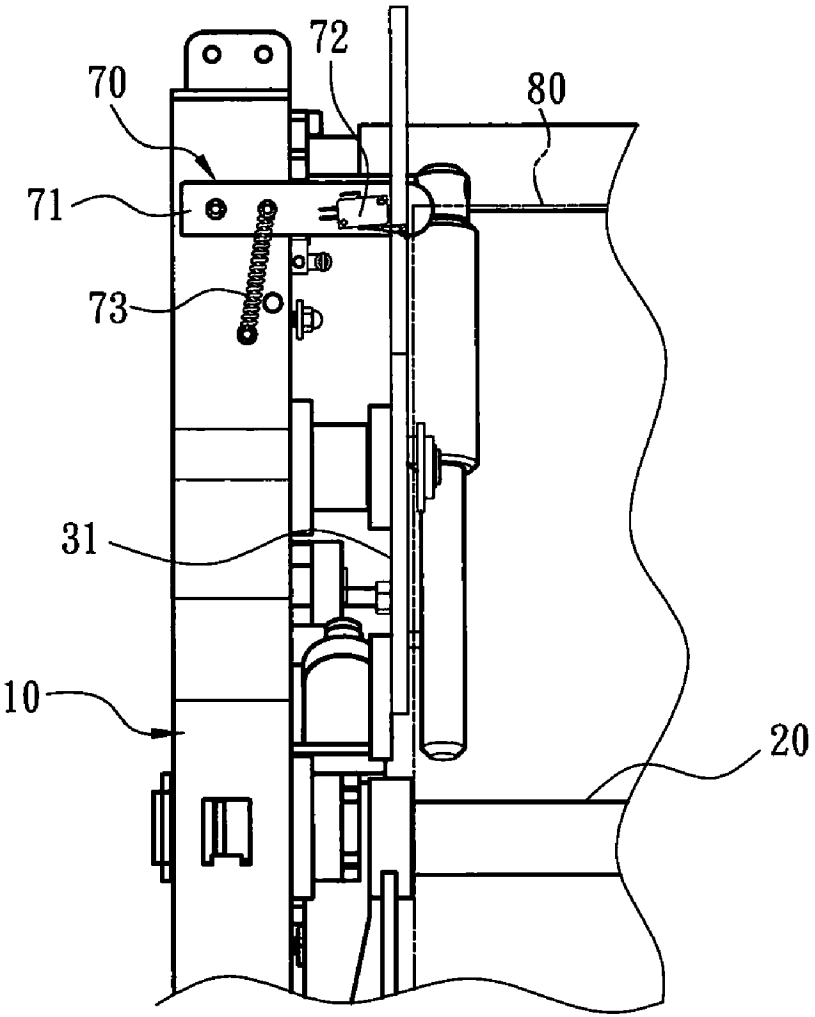
Figure 7D:
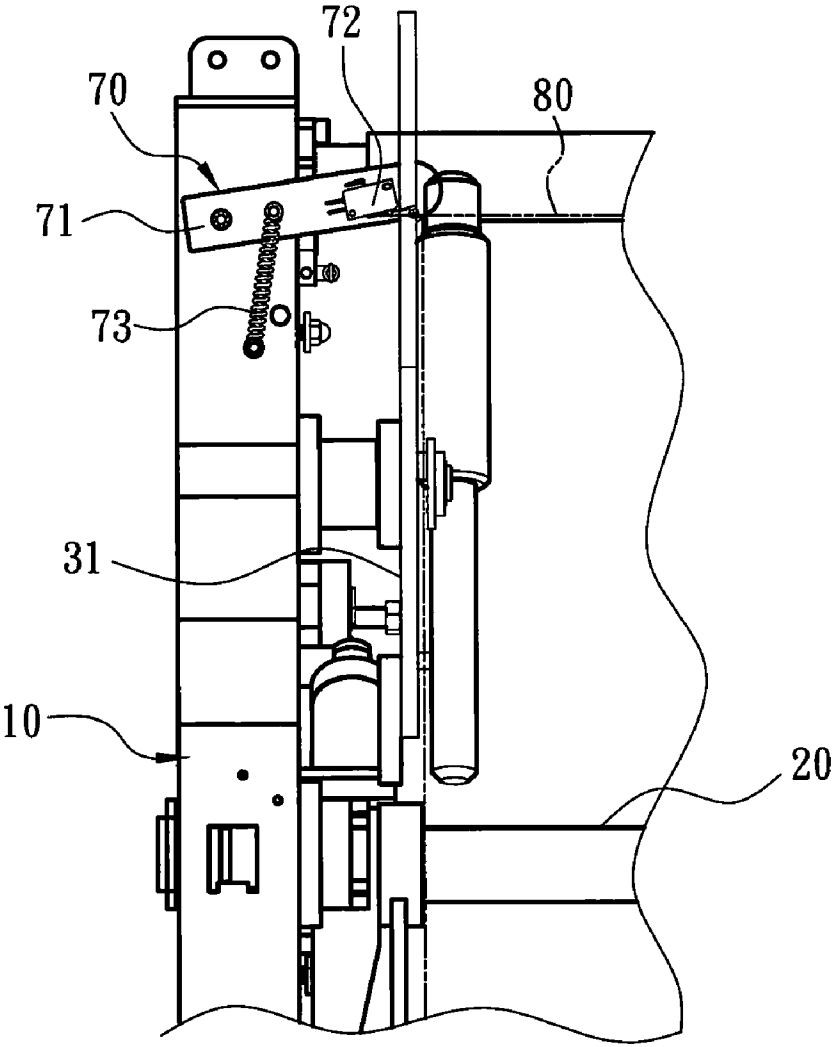

When the fabric 80 rolled on the fabric rolling rod 20 increases gradually, the arm 31 is turned pivotally at a greater angle and could hit the fabric conveying means 40 above. To prevent such a problem from happening, the invention further provides a safety means 70 on the moving path of the fabric pressing means 30 lifted by the fabric 80. Referring to FIG. 6, the safety means 70 includes a swivelable rod 71 hinged in the side chest 1 and an elastic element 73 connected to the side chest 1 and the swivelable rod 71. The swivelable rod 71 has a trigger switch 72 located thereon. Referring to FIGS. 7A through 7D, when the arm 31 is turned pivotally by excessive amount of the fabric 80 and contacts the trigger switch 72, the trigger switch 72 issues a signal to the driving means to stop driving operations. Meanwhile, the arm 31 butts the swivelable rod 71 to make it swiveling, and the elastic element 73 provides a buffer effect. Thus there is no need to provide manual monitoring, and an automatic stop can be achieved when the fabric collection structure is fully loaded with fabric.

As a conclusion, the present invention provides the fabric rolling rod 20 to rotate axially at a fixed location to roll the fabric 80, and the fabric pressing means 30 to press the fabric 80 rolled on the fabric rolling rod 20. The fabric pressing means 30 is lifted upwards with increasing thickness of the fabric 80. Thus a constant downward pressure is applied on the fabric 80 rolled on the fabric rolling rod 20 to achieve a uniform density of the fabric 80. As a result, fabric collection quality of the fabric cutting apparatus 50 improves.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A fabric collection structure for a fabric cutting apparatus which splits a fabric knitted by a knitting machine and has a driving means to drive the fabric collection structure to collect the fabric, comprising:

a fabric rolling rod axially located on the fabric collection structure and driven by the driving means to rotate and roll the fabric; and a fabric pressing means which has a first fabric spread rod and a fabric pressing rod that are axially located on the fabric collection structure, the first fabric spread rod being driven by the driving means to flatly unfold the fabric split by the fabric cutting apparatus, the fabric pressing rod pressing the fabric on the fabric rolling rod and driven by the driving means to drive the fabric to be rolled on the fabric rolling rod, the fabric pressing means being lifted by increasing thickness of the fabric rolled on the fabric rolling rod during fabric collection process.

2. The fabric collection structure of claim 1 further having a control means coupling with the fabric pressing means to adjust elevation thereof.

3. The fabric collection structure of claim 2, wherein the control means includes an oil pressure buffer connecting to the fabric pressing means and an oil pressure control box to control oil pressure of the oil pressure buffer.

4. The fabric collection structure of claim 3, wherein the oil pressure control box has an oil pressure control switch to boost the pressure or release the pressure of the oil pressure buffer.

5. The fabric collection structure of claim 3, wherein the oil pressure control box has a pressure boosting handle to increase the pressure of the oil pressure buffer.

6. The fabric collection structure of claim 1 further having a safety means located on a moving path of the fabric pressing means lifted by the fabric, the safety means having a trigger switch butted by the fabric pressing means to stop operation of the driving means.

7. The fabric collection structure of claim 6, wherein the safety means includes a swivelable rod hinged on the fabric collection structure and an elastic element connecting to the fabric collection structure and the swivelable rod, the fabric pressing means butting the swivelable rod to form buffering.

* * * * *